United States Patent [19]

O'Brien

[11] 4,118,034

[45] Oct. 3, 1978

[54] GOLFER'S STANCE BLOCK

[76] Inventor: John P. O'Brien, 175 E. Delaware Pl., Chicago, Ill. 60611

[21] Appl. No.: 780,271

[22] Filed: Mar. 23, 1977

Related U.S. Application Data

[63] Continuation-in-part of Ser. No. 753,927, Dec. 23, 1976, Pat. No. 4,073,075, and a continuation-in-part of Ser. No. 735,761, Oct. 26, 1976, Pat. No. 4,081,918, and a continuation-in-part of Ser. No. 683,898, May 6, 1976, abandoned.

[51] Int. Cl.[2] ..... A63B 57/00; A63B 69/30

[52] U.S. Cl. ..... 273/32 C; 128/590; 36/127

[58] Field of Search ..... 273/32 C, 187 B, 187 R, 273/187 A; 36/127, 65; 128/80 J, 581, 586, 589, 590, 80 D

[56] References Cited

U.S. PATENT DOCUMENTS

| | | | |
|---|---|---|---|
| 908,040 | 12/1908 | Secrist | 36/65 |
| 1,998,342 | 4/1935 | Sturgeon | 36/127 X |
| 3,951,407 | 4/1976 | Calacurcio | 273/32 C |

*Primary Examiner*—George J. Marlo
*Attorney, Agent, or Firm*—Cook, Wetzel & Egan, Ltd.

[57] ABSTRACT

Wedge-shaped golf training devices are provided with elements to removably affix the devices to the bottom of a conventional or a modified shoe. Several embodiments of the affixing elements are described, including a dovetail joint-like configuration, a wedge engaging pin mounted in the shoe, and a sole mounted magnetic device.

5 Claims, 7 Drawing Figures

GOLFER'S STANCE BLOCK

This application is a continuation-in-part of my copending patent applications Ser. No. 753,927 filed Dec. 23, 1976, now U.S. Pat. No. 4,073,075, Ser. No. 735,761 filed Oct. 26, 1976, now U.S. Pat. No. 4,081,918, and Ser. No. 683,898 filed May 6, 1976, now abandoned.

The present invention relates to a golf training device, and more particularly to a wedge-shaped golf training device which may be removeably affixed to the bottom of either a conventional shoe or a specially designed or modified shoe, thus enabling a golfer to practice his golf swing using the training device, but to readily remove the training device from the shoe for ordinary use. The golf training device of the present invention may also be used with specially designed or modified golf shoes, or with conventional street shoes or sport shoes, with or without suitable modification. The golf training device of the present invention is designed to be affixed to a specially designed or modified shoe, which has an ordinary appearance, i.e., the modification is not highly visible or obvious.

It is well known that many individuals could play an improved game of golf if they could develop a proper and consistent golf swing. Various books and articles on golf have been written wherein the proper form and style of golf swing is described. However, simply reading a book or article on how to swing a golf club and hit a golf ball does not inherently provide a golfer with the feel of a proper and consistent swing, nor does it provide him with a proper and consistent swing.

One of the major shortcomings in the swing of many golfers, and particularly among the high handicap golfers, is a tendency to sway "off the ball", i.e., away from the intended target, during the backswing, coupled with a failure to sway back to the point at which the swing was started during the downswing. This fundamental error causes the golfer to have most of his weight on his rear foot and to swing from his rear foot, when the club head is brought back to the ball, which, in turn, frequently results in a slice, a topped shot, a smothered duckhook or other types of miss-hit golf shots which will be known to those having the ordinary skill in the art.

It has been recognized by golfers, and particularly golf teachers or golf teaching professionals that the tendency to sway "off the ball", away from the intended target, can be reduced if a golfer's rearward foot (the foot furthest from the intended target) is canted or tilted toward the target which causes the weight placed on this foot to move to the inside edge of the foot. The canting of the rear foot toward the target also tends to keep the golfer's weight equally distributed between the rear foot and the front foot and serves as a reminder to the golfer to avoid swaying "off the ball" during the backswing.

It is theorized that canting the rear foot toward the target will allow a golfer to transfer as much as 60 or 70% of his weight to the inside edge of his rear foot, but at the same time a substantial portion of the golfer's weight will remain on the front foot throughout the entire swing including the top of the backswing. Canting the rear foot toward the target will tend to force the golfer to keep his weight on the inside edge of his foot and thus reduce the chances that the golfer will transfer all of his weight to the rear foot. When the golfer's weight is thus distributed at the top of his backswing, i.e., no more than about 70% of his weight on the rear foot, he is able to shift his weight to the front foot during the downswing, at the same time maintain a steady head position on "over the ball".

Many devices have been devised by the prior art in order to accomplish the canting of the rear foot toward the target. Some golf teaching professionals simply suggest that their pupils place a golf ball under the outside edge of the rear foot. While such an expedient can be used, every time the golfer wishes to reposition his rear foot, it is necessary to reposition the golf ball under his shoe.

The prior art has suggested the use of golf shoes wherein one or both of the shoes are canted inwardly. In particular, one publication suggests that the rear foot be equipped with a shoe which is canted toward the target. However, this publication describes a shoe which is permanently raised along its outer edge. While this might achieve some of the objectives of the present invention, insofar as giving the golfer the feel of the correct golf swing, such shoes are not adapted to be used as an ordinary street shoe or as ordinary golf shoes. Further, walking substantial distances with one shoe canted would probably be uncomfortable and might cause various orthopedic problems.

Applicant's U.S. Pat. No. 3,218,734 describes a removable supporting attachment for golf shoes, wherein the removable support is adapted to be affixed to a specifically designed spike or cleat in a golf shoe, which is inserted in the golf shoe for the purpose of holding the support attachment. While this device was successful in giving a golfer the correct feel of a proper swing, and had the advantage of being removable, the means for attaching the supporting device required the use of a special spike or cleat which had certain inherent limitations. As a practical matter, the device of U.S. Pat. No. 3,218,734 was not readily usable with ordinary street shoes or sport shoes other than golf shoes.

Applicant's copending application Ser. No. 661,779 filed Feb. 24, 1976, describes a golf training device adapted to be removably affixed to a golf shoe, wherein an annular magnet holds the training device to the flange of a standard golf spike which is mounted on a golf shoe. While the device described and claimed in the copending application has many desirable attributes, it is not adapted to be used on shoes other than golf shoes which are fitted with conventional spikes.

Applicant's copending parent application Ser. No. 683,898 filed May 6, 1976, provides a wedge-shaped golf training device adapted to be removably affixed to a shoe which need not be a golf shoe, but which is modified suitably to receive the wedge-shaped golf training device. In particular, the wedge-shaped golf training device is fitted with one or more sole-engaging pins, adapted to mate with one or more complementary holes in the sole of the shoe, preferably located under the arch, horizontal and parallel to the ordinarily plane of the shoe. Since a great deal of golf practice is conducted at driving ranges which are open to the public, it is important to provide a training device which may be used with shoes adapted to be used for ordinary purposes. Many of the customers at such driving ranges are not equipped with golf shoes, but are wearing street shoes or sports shoes of various configurations not equipped with golf spikes. The golf training device of the parent application, Ser. No. 683,898, discloses and claims a wedge-shaped golf training device which could be affixed to conventional shoes which were produced or suitably modified to mate with golf training device.

Applicant's co-pending parent application, Ser. No. 735,761 filed Oct. 26, 1976, provides a wedge-shaped golf training device which can be affixed to an ordinary pair of shoes of any type without any modification to the shoe. The golf training device of application Ser. No. 735,761 includes a clamping means which holds the device to the shoe through the use of a clamping means which engages the edges of the shoe sole and holds the shoe sole or shoe bottom under compression, and thereby holding the training device in the desired location on the shoe. While the golf training device described in application Ser. No. 735,761 has a major advantage in that it is adapted to be used with either a conventional street shoe, a sport shoe, or a conventional golf shoe and does not require the shoe to be modified, it is relatively expensive to manufacture. Also, the device provided by Ser. No. 735,761 is limited to use on shoe sizes within a certain range of sizes, depending upon the width of the clamping means, both in the open position and the closed position.

The present invention is directed to a golf training device, having a similar wedge-shaped configuration, which can be economically manufactured, and which can be used in conjunction with ordinary shoes which may have minimal modifications or which are modified in a manner so as to have the appearance of an ordinary street shoe, sports shoe, or a golf shoe. In other words, the golf training device of the present invention is adapted to be used with either conventional shoes or with shoes which need be modified only with elements which are not highly visible and are not readily obvious to the ordinary observer.

The advantages of the present invention, and its various embodiments, will become apparent from the following specification and claims, and the accompanying drawings in which:

Figure 1:
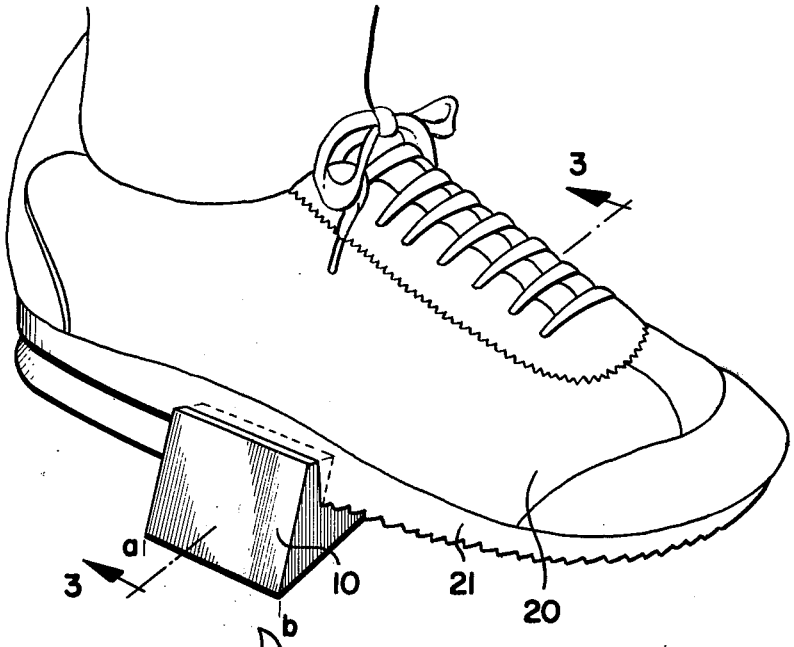
FIG. 1 is an isometric view of the wedge-shaped golf training device of the first embodiment of the present invention affixed to a sports shoe for the right foot, as it would be used in practice.
Figure 5:
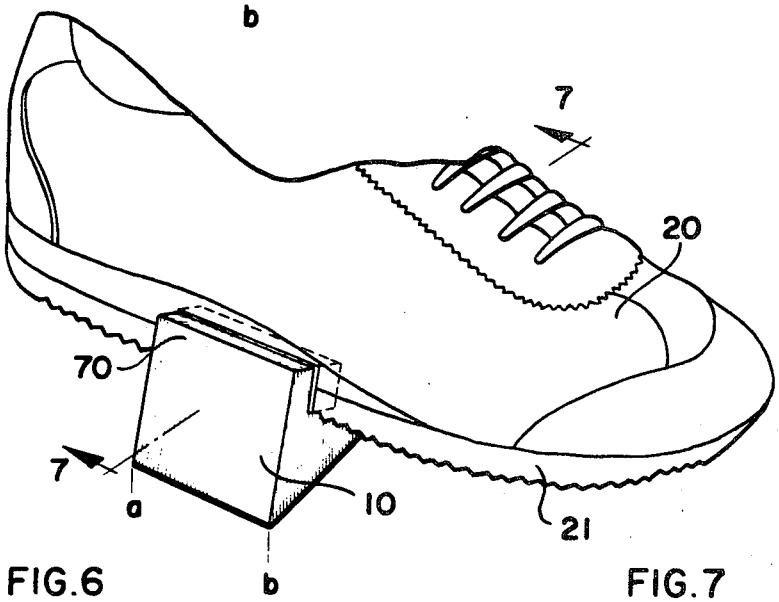
FIG. 5 is an isometric view of the wedge-shaped golf training device of the third embodiment of the present invention affixed to a sports shoe for the right foot, as it would be used in practice.
Figure 6:
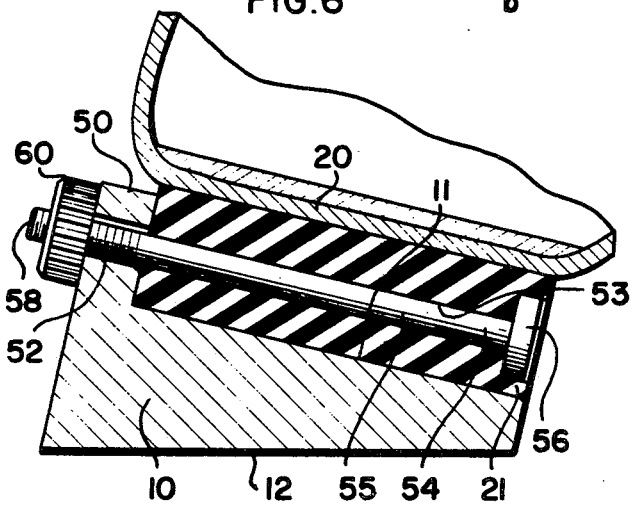
FIG. 6 is a sectional side view taken in section 6—6 of FIG. 4, showing the golf training device of the second embodiment of the present invention in place on a sports shoe.

The wedge-shaped golf training device of the present invention, as it would be used by righthanded golfers, is shown affixed to the shoe for the right foot in FIGS, 1, 5 and 6. The training device as shown is placed on the outside edge of the rear foot (the foot furthest from the intended target), thus inwardly canting the right foot of the righthanded golfer toward the target which lies ahead and to the golfer's left side. When in place, as is shown in FIGS. 1, 5 and 6, the training device tends to cause the golfer to weight the inside edge of his right foot. Thus when the training device is in place, any weight shifted to the right foot will tend to remain on the inside of the foot, thus minimizing the chances that the golfer will sway to the rear, "off the ball", and away from the target during the backswing. Lefthanded golfers could use the golf training device in the same manner, by affixing it to their rear foot, i.e., their left foot.

All of the embodiments of the golf training devices of the present invention which are shown in FIGS. 1–7, inclusive, include a wedge-shaped body 10 which serves as the main supporting member for the shoe 20 which is to be canted. The wedge-shaped body includes an upper surface 11 adapted to support the bottom or sole 21 of shoe 20. The wedge-shaped body 10 also includes a lower, ground-engaging surface 12, more clearly shown in FIG. 3, which defines an acute angle with respect to upper surface 11. While the angle beteen upper surface 11 and ground-engaging surface 12 is not critical, it is generally preferred to have an angle of about 30°. The lower, ground-engaging surface 12 is preferably planar, although it may be knurled or otherwise fashioned to produce an increased frictional engagement with the ground, thus reducing the possibility of slippage in use. The lower end of wedge-shaped body 10 is desirably truncated in order to reduce the overall length and facilitate storage when not in use. The width of the wedge-shaped (as measured from point *a* to point *b* of FIGS. 1, 2, 5 and 6) member may also be varied over wide limits. It has been found that a width of from 1 to 2 inches (as measured from point *a* to point *b* in FIGS. 1, 2, 5 and 6) is preferred, although greater or lesser widths may be employed.

While it is preferred to install the golf training device under the arch portion of the shoe, as is shown in FIG. 1, the training device may be used on any portion of the shoe. If it is to be employed on the widest portion of the shoe, i.e., under the ball of the foot, it is preferable to produce a somewhat wider wedge, i.e., the width of the upper surface 11 should be as much as 4½ inches, as measured between upper extension 13 and lower extension 14.

While it is generally preferred that upper support surface 11 be essentially planar, the present invention also contemplates the use of non-planar surfaces. For example, the surface 11 may be formed into an irregular surface or into a surface which complements the lower surface of the shoe sole.

Having reference to the first embodiment of the wedge-shaped golf training device of the present invention, and particularly to FIGS. 1–3, inclusive, the wedge-shaped device includes two extensions 40 and 44 which extend above upper surface 11, hereinafter referred to as upper extension 40 and lower extension 44. Upper and lower extensions 40 and 44 are adapted to engage the outer and inner edges 41 and 45 of the shoe sole or shoe bottom 21. In its preferred embodiment, the first embodiment of the wedge-shaped golf training device forms a dovetail joint between the wedge-shaped body (contemplating its upper extension 40, upper surface 11, and lower extension 44) and the shoe (contemplating outer edge 41, sole 21, and inner edge 45).

Figure 2:
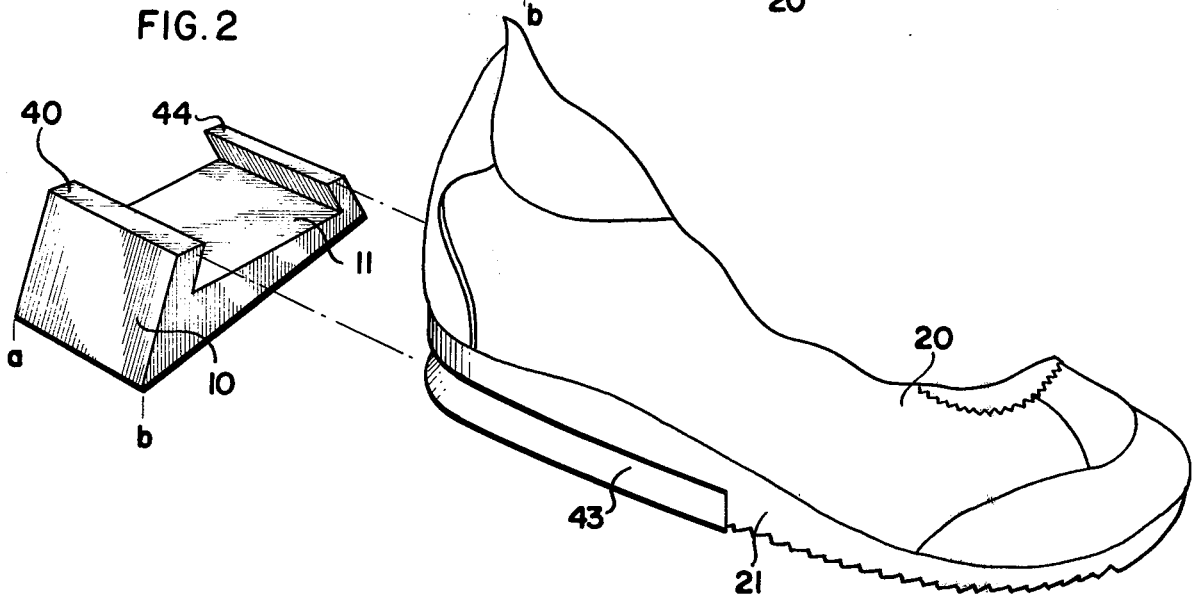
FIG. 2 is an isometric view of the wedge-shaped golf training device of the first embodiment of the present invention showing the device removed from the shoe, by moving it to the rear of the shoe, wherein the dovetail is separated from the shoe bottom.

As can be more clearly seen in FIG. 2, it is preferred that the shoe be manufactured with a channel 43 extending from the arch of the shoe rearwardly adapted to form a dovetail joint. It is contemplated that the channel 43 exist on both sides of the shoe, running in parallel lines or direction on both sides, and extend continuously from the "under the arch" position rearwardly, and advantageously may extend around the entire rear, or heel portion of the shoe. In this embodiment the wedge-shaped golf training device may be attached to the shoe by sliding it from the rear of the shoe, over the heel, to the "under the arch" position which is preferred for use.

Figure 3:
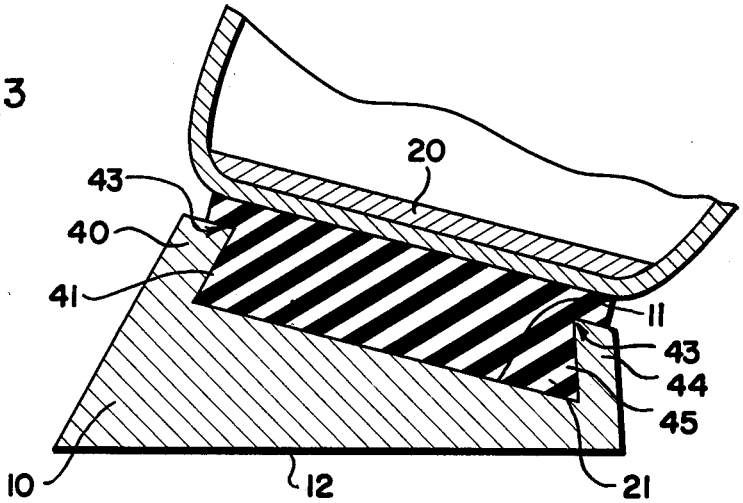
FIG. 3 is a sectional side view, taken in vertical section, taken in section 3—3 of FIG. 1, showing the golf training device of the first embodiment in place on the shoe.

If desired, the wedge-shaped golf training device of the first embodiment may be made of a rigid material in which case the cross-sectional shape of channel 43 should complement the cross-sectional shape of the sides of the wedge-shaped golf training device as is shown in FIG. 3. Shoes fitted in accordance with the first embodiment of the present invention, may have a standardized channel 43, with a standarized dovetail width built into the shoe, so that a given wedge-shaped training device may fit several shoe sizes.

Alternatively, the wedge-shaped golf training device of the first embodiment may be made from a flexible or elastomeric material, i.e., a plastic material with a plastic memory, a cured rubber, or other composition which is fairly readily deformable, but which will return to its original shape. In that case the wedge-shaped golf training device of the first embodiment may be used to engage the sole of a conventional shoe, or of a modified shoe, wherein a channel 43 forms a male dovetail joint along the length or a portion of the length of an entire sole of the shoe.

It will be obvious to those skilled in the art that when a wedge-shaped golf training device of the first embodiment is to be employed with a conventional shoe, having a conventional sole thereon, that the extensions 40 and 44 are preferably, but not necessarily, fabricated with inner surfaces which are complementary to the outside edges of the sole of the shoe.

In the golf training device of the first embodiment, it is generally preferred that the extensions 40 and 44 be spaced approximately the same width as the shoe sole at the point desired for attachment. While it is necessary to have a space in between extensions 40 and 44 approximately the right size for each shoe size and design, the sizing is less critical with respect to the alternative embodiment wherein the device is fabricated from relatively inexpensive materials, such as plastics, synthetic rubbers and the like, and simply snapped into place when it is desired to use these devices. Removal of the device from the shoe, after the desired practice has been accomplished, can be accomplished by simply removing the device or unsnapping the extensions 40 and 44 from the edges of the sole 41 and 45. In the preferred embodiment of the first embodiment, the rigid wedge-shaped device may be slid to the rear of the shoe, along channel 43 for removal.

Figure 4:
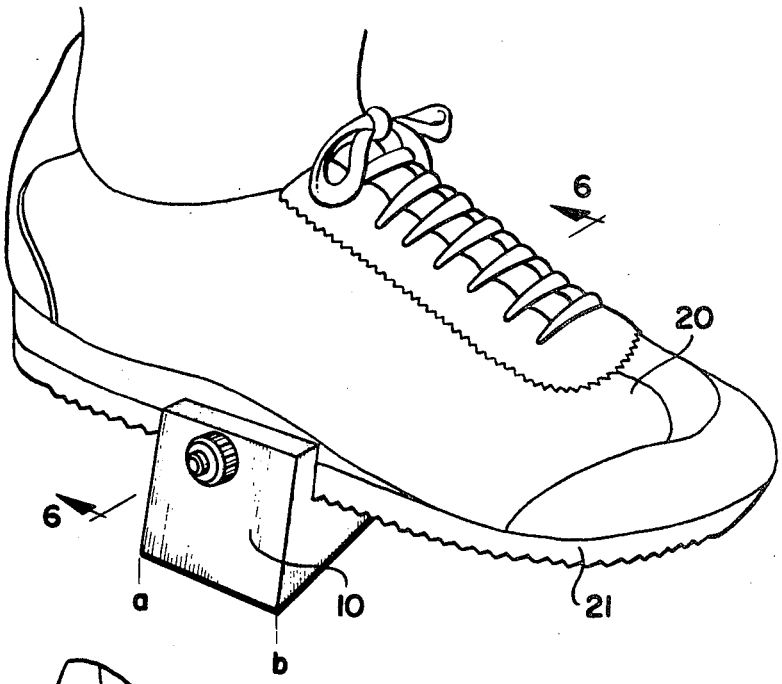
FIG. 4 is an isometric view of the wedge-shaped golf training device of the second embodiment of the present invention affixed to a sports shoe for the right foot, as it would be used in practice.

In the second embodiment of the present invention, as illustrated by FIGS. 4 and 6, the wedge-shaped device comprises single extension 50 on the upper end of wedge 10. An opening 52 is located in extension 50 and preferably is approximately parallel to upper surface 11. The second embodiment of the present invention is used with a shoe having a transverse opening 53 in the sole or bottom and preferably approximately parallel to the bottom surface and adapted to receive pin 54. Pin 54 comprises a shaft member 55, head 56 and threaded end 58. The pin is adapted to be inserted in opening 53, and may be permanently or temporarily secured therein, whereby shaft member 55 protrudes through opening 53, exposing threaded portion 58. The wedge-shaped training device may be secured to the bottom of the shoe by fitting the pin 54 through opening 52 of extension 50, thus exposing threaded portion 58, and engaging nut 60 on threaded portion 58.

The second embodiment, as shown in FIGS. 4 and 6, possesses a marked advantage in that a given wedge will fit any type or size of shoe. The wedge-shaped device may be made of any convenient material, such as wood, metal, plastic or other substances, it being only required that upper extension 50 have sufficient rigidity and tensile strength so as to provide a mechanical connection to the pin member 54.

Figure 7:
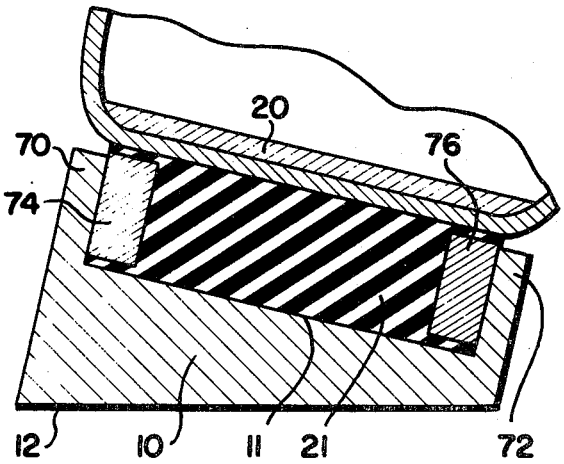
FIG. 7 is a sectional side view, taken in section 7—7 of FIG. 5, showing the golf training device of the third embodiment of the present invention in place on the golf shoe.

The third embodiment of the present invention, which is illustrated by FIGS. 5 and 7, contemplates a wedge-shaped golf training device fabricated in whole or in part from a magnetically susceptible substance, and preferably fabricated from a ferrous metal. The third embodiment includes an upper extension 70 and preferably a lower extension 72. Mounted within the sole or bottom of the shoe, is one or more magnetic devices 74 and 76, adapted to magnetically attract the magnetically susceptible material on the wedge-shaped device, whereby the wedge-shaped device is removably affixed to the shoe.

Although the third embodiment illustrated herein shows the wedge-shaped device being held in place by two magnets 74 and 76, each of which is located in the outer edge of sole or shoe bottom 21, those skilled in the art will be aware that the number and location of the magnets may be widely varied, the criteria being that the total attraction of the magnets to the wedge-shaped golf training device must be sufficient to hold the wedge-shaped training device in place as desired during the golf practice. The size and location of the magnets will be determined to some extent by the materials of construction, and the spacing of the magnets from the golf training device.

While the device illustrated in FIGS. 5 and 7 shows two extensions, i.e., the upper extension 70 and lower extension 72, those skilled in the art will be aware that one extension may be eliminated if desired, although two extensions are preferred. Further, those skilled in the art will be aware that the configuration of the extensions may vary to accomplish various aesthetic appearances.

Except as explained above, the wedge-shaped device of the present invention may be constructed of any desired material of construction, including metal, plastic, wood or combinations thereof. It will be understood by those skilled in the art that other equivalent attaching devices may be used, so long as they are adapted to hold the shoe sole under compression, whereby the training device is removable, but frictionally held to the shoe in the desired position. The forms of invention herein shown and described are to be considered only as illustrative. It will be apparent to those skilled in the art that numerous modifications may be made therein without departure from the spirit of the invention or scope of the appended claims.

I claim:

1. A wedge-shaped golf training device adapted to be removably affixed to a shoe, said training device comprising a wedge-shaped body having a lower, ground engaging surface, and an upper support surface, said upper support surface adapted to support the lower surface of a shoe, said wedge-shaped body including an upper extension and a lower extension, said extensions extending upwardly from said upper support surface, said extensions having inward surfaces inwardly inclined whereby an acute angle is formed by said inward surfaces and said upper support surface, said inward surfaces being adapted to engage the opposite outer edges of the sole of the shoe.

2. A wedge-shaped golf training device as described in claim 1, wherein the inward surfaces of said extensions are shaped to complement the shape of the opposite outer edges of a shoe sole.

3. A wedge-shaped golf training device as described in claim 2, wherein the inward surfaces of said extensions in combination with said upper support surface describe the female portion of a dovetail joint.

4. A wedge-shaped golf training device as described in claim 3, wherein said device is fabricated from a substantially rigid material.

5. A wedge-shaped golf training device as described in claim 1, wherein said device is fabricated from a flexible material.

* * * * *